US011772130B2

(12) United States Patent
Bissett

(10) Patent No.: US 11,772,130 B2
(45) Date of Patent: Oct. 3, 2023

(54) SHAKER SCREEN ASSEMBLY WITH UNDULATION SEALING TABS

(71) Applicant: Continental Wire Cloth, LLC, Jenks, OK (US)

(72) Inventor: James R. Bissett, Broken Arrow, OK (US)

(73) Assignee: CONTINENTAL WIRE CLOTH, LLC, Jenks, OK (US)

( * ) Notice: Subject to any disclaimer, the term of this patent is extended or adjusted under 35 U.S.C. 154(b) by 0 days.

(21) Appl. No.: 17/559,471

(22) Filed: Dec. 22, 2021

(65) Prior Publication Data

US 2022/0193726 A1 Jun. 23, 2022

Related U.S. Application Data

(60) Provisional application No. 63/130,049, filed on Dec. 23, 2020.

(51) Int. Cl.
*B07B 1/46* (2006.01)

(52) U.S. Cl.
CPC ..... *B07B 1/4663* (2013.01); *B07B 1/469* (2013.01); *B07B 1/4618* (2013.01)

(58) Field of Classification Search
CPC ..... B07B 1/4663; B07B 1/4618; B07B 1/469; B07B 1/4609; B07B 1/46
USPC ..... 209/412
See application file for complete search history.

(56) References Cited

U.S. PATENT DOCUMENTS 5,417,859 A * 5/1995 Bakula ..... B01D 33/0392 209/403
5,490,598 A * 2/1996 Adams ..... B07B 1/48 209/403
5,690,826 A * 11/1997 Cravello ..... B07B 1/469 210/384
5,783,077 A 7/1998 Bakula
5,868,929 A * 2/1999 Derrick ..... B07B 1/469 209/403
5,876,552 A 3/1999 Bakula
5,944,993 A 8/1999 Derrick et al.
5,958,236 A * 9/1999 Bakula ..... B07B 1/4672 209/403
6,029,824 A * 2/2000 Adams ..... B07B 1/48 209/403

(Continued)

FOREIGN PATENT DOCUMENTS

WO WO-2017176245 A1 * 10/2017 ..... B01D 33/0384

*Primary Examiner* — Gene O Crawford
*Assistant Examiner* — Muhammad Awais
(74) *Attorney, Agent, or Firm* — MCAFEE & TAFT

(57) ABSTRACT

A shaker screen assembly comprising a support frame and a screen subassembly attached to the support frame is provided. The screen subassembly includes a planar panel that includes a plurality of undulation sealing tabs, and a mesh section attached to the planar panel. The mesh section includes a series of undulations, each undulation including an elongated base portion and an elongated raised portion. The mesh section is attached to the planar panel such that the elongated raised portions form a series of elongated open areas having open ends and an undulation sealing tab of the planar panel is positioned in each of the open ends. The undulation sealing tabs help prevent fluid from leaking or flowing through the open ends when the shaker screen assembly is in use.

16 Claims, 7 Drawing Sheets

(56) References Cited

U.S. PATENT DOCUMENTS 6,032,806 A * 3/2000 Leone ..... B07B 1/4627 209/403
6,209,726 B1 * 4/2001 Gallia ..... B07B 1/4663 209/403
6,290,068 B1 * 9/2001 Adams ..... B07B 1/4645 210/488
6,340,089 B1 1/2002 Bakula
6,564,947 B2 5/2003 Bakula
6,669,027 B1 * 12/2003 Mooney ..... B07B 1/48 209/403
7,228,971 B2 6/2007 Mooney et al.
8,021,547 B2 * 9/2011 Hukki ..... B07B 1/46 209/403
2002/0079251 A1 * 6/2002 Schulte ..... B01D 33/0376 209/325
2004/0112522 A1 * 6/2004 Ward ..... B01D 29/07 156/290
2004/0211707 A1 * 10/2004 Lipa ..... B07B 1/4618 209/397
2004/0245155 A1 * 12/2004 Strong ..... B01D 33/0376 209/405
2005/0035033 A1 * 2/2005 Adams ..... B32B 37/1292 209/392
2005/0056570 A1 * 3/2005 Colgrove ..... B07B 1/469 209/393
2008/0029442 A1 * 2/2008 Schulte, Jr. ..... B07B 1/4663 209/403
2014/0291238 A1 * 10/2014 Cady ..... B07B 1/4654 264/275
2016/0288171 A1 10/2016 Bissett
2018/0214798 A1 * 8/2018 Cady ..... B01D 39/12
2018/0312667 A1 * 11/2018 Colgrove ..... C08G 18/48
2019/0321859 A1 * 10/2019 Wojciechowski .... B07B 1/4645
2020/0246833 A1 * 8/2020 Wojciechowski .... B07B 1/4609

* cited by examiner

SHAKER SCREEN ASSEMBLY WITH UNDULATION SEALING TABS

CROSS-REFERENCE TO RELATED APPLICATION

This application claims the benefit of prior-filed U.S. provisional application No. 63/130,049 (filed on Dec. 23, 2020), which is incorporated by reference herein.

BACKGROUND

A vibratory shaker machine, sometimes referred to as a shale shaker or mud shaker (hereafter a "shaker machine"), is used in the oil and gas industry and other industries to separate solids from a mixture of solids and liquids. For example, shaker machines are commonly used in processes for reclaiming used oil and gas well drilling mud in order to separate rock, cuttings, and other solid particles from the mud before the used mud is further processed.

In operating a shaker machine, the mixture of solids and liquids is caused to flow onto and through a shaker screen assembly, which is removably attached to the shaker machine and functions to filter solids from the mixture of solids and liquids. In order to facilitate the filtration process and cause the separated solids to slide off the top of the shaker screen assembly as the process is carried out, the shaker screen assembly is caused to vibrate by the shaker machine. Usually, two or more shaker screen assemblies are positioned side by side on the shaker machine. Due to the strong vibratory forces and harsh environments to which shaker screen assemblies are subjected, they tend to wear out relatively quickly. As a result, in many applications, the shaker screen assemblies mounted to a shaker machine must be replaced every couple of weeks or so.

A typical shaker screen assembly includes a support frame and a screen subassembly. The screen subassembly comprises a mesh section that includes one or more stainless steel mesh layers (for example, three mesh layers) and is attached to a perforated panel. The perforated panel supports the mesh section. The screen subassembly is attached to the top of the support frame. The support frame helps hold the shaker screen assembly in position within the shaker machine and supports the screen subassembly during use. The sizes of the various openings in the mesh layer(s) (and hence the mesh section) and the ultimate cut point and API classification of the shaker screen assembly vary depending on the particular application including the size of the solid particles that need to be separated from the mixture. Each type or model of shaker screen assembly is generally available in a variety of cut points and API classifications.

In the past, the mesh sections attached to the perforated panels of screen subassemblies have been generally flat in shape. In such a screen subassembly, the bottom of the mesh section is bonded, directly or indirectly, to the perforated panel. Today, although screen subassemblies having generally flat mesh sections are still in use, many screen subassemblies now have undulating mesh sections, that is, mesh sections that have a series of elongated base portions and elongated raised portions running from one side of the mesh section to the other. In such a screen subassembly, the undulating nature of the mesh section can increase the surface area and effective filter area of the shaker screen assembly while allowing the overall length and width of the assembly to stay the same, thereby allowing the assembly to continue to fit existing shaker machines.

In a screen subassembly that includes an undulating mesh section, the elongated raised portions form a series of elongated open areas running from one side of the mesh section to the other and having open ends positioned adjacent to the periphery of the screen subassembly. In order to prevent fluid to be filtered by the shaker screen assembly from merely flowing through the open ends of the elongated open areas instead of the perforated metal panel and bottom of the shaker screen assembly, the open ends of the elongated open areas are typically filled with an epoxy material.

Unfortunately, the step of filling the open ends of the elongated open areas formed by the elongated raised portions of an undulating screen subassembly with an epoxy material is a time-consuming process. Furthermore, when the shaker screen assemblies are used, the epoxy material often becomes cracked or is shaken completely out of the open ends, causing the shaker screen assembly to fail to work properly.

SUMMARY

In one aspect, a shaker screen assembly is provided. The shaker screen assembly comprises a support frame that defines a frame opening, and a screen subassembly attached to the support frame. The support frame has a top frame surface and a bottom frame surface opposing the top frame surface. The screen subassembly includes:

a planar panel having an upper panel surface, a lower panel surface opposing the upper panel surface, a panel peripheral sidewall connecting the upper panel surface and the lower panel surface together, a plurality of undulation sealing tabs attached to the planar panel and extending approximately perpendicularly with respect to the upper panel surface and the lower panel surface, and a plurality of panel perforations extending through the upper panel surface and the lower panel surface; and a mesh section attached to the planar panel and including at least one mesh layer, the mesh section having a top mesh section surface, a bottom mesh section surface opposing the top mesh section surface, a mesh section peripheral edge connecting the top mesh section surface and the bottom mesh section surface together, and a plurality of mesh section openings extending through the top and bottom mesh section surfaces, wherein the mesh section peripheral edge includes a first side and an opposing second side and the mesh section includes a series of undulations extending from the first side of the mesh section peripheral edge to the second side of the mesh section peripheral edge, each of the undulations including an elongated base portion and an elongated raised portion, and wherein the mesh section is attached to the planar panel such that:

a) the mesh section openings are positioned over the panel perforations;

b) the elongated base portions of the undulations are attached to the upper panel surface;

c) the elongated raised portions of the undulations form a series of elongated open areas positioned between the upper panel surface and the bottom mesh section surface and extending over the panel perforations from the first side of the mesh section peripheral edge to the second side of the mesh section peripheral edge, each of the elongated open areas having a first open end and a second open end opposing the first open end, each of the first and second open ends being positioned adjacent to the panel peripheral sidewall and mesh section peripheral edge; and d) an undulation sealing tab of the planar panel is positioned in each of the first and second open ends of the elongated open areas.

In another aspect, a screen subassembly is provided. The screen subassembly comprises a planar panel and a mesh section attached to the planar panel. The planar panel has an upper panel surface, a lower panel surface opposing the upper panel surface, a panel peripheral sidewall connecting the upper panel surface and the lower panel surface together, a plurality of undulation sealing tabs attached to the planar panel and extending approximately perpendicularly with respect to the upper panel surface and the lower panel surface, and a plurality of panel perforations extending through the upper panel surface and the lower panel surface. The mesh section includes at least one mesh layer, the mesh section having a top mesh section surface, a bottom mesh section surface opposing the top mesh section surface, a mesh section peripheral edge connecting the top mesh section surface and the bottom mesh section surface together, and a plurality of mesh section openings extending through the top and bottom mesh section surfaces, wherein the mesh section peripheral edge includes a first side and an opposing second side and the mesh section includes a series of undulations extending from the first side of the mesh section peripheral edge to the second side of the mesh section peripheral edge, each of the undulations including an elongated base portion and an elongated raised portion, and wherein the mesh section is attached to the planar panel such that:

a) the mesh section openings are positioned over the panel perforations;

b) the elongated base portions of the undulations are attached to the upper panel surface;

c) the elongated raised portions of the undulations form a series of elongated open areas positioned between the upper panel surface and the bottom mesh section surface and extending over the panel perforations from the first side of the mesh section peripheral edge to the second side of the mesh section peripheral edge, each of the elongated open areas having a first open end and a second open end opposing the first open end, each of the first and second open ends being positioned adjacent to the panel peripheral sidewall and mesh section peripheral edge; and d) an undulation sealing tab of the planar panel is positioned in each of the first and second open ends of the elongated open areas.

In yet another aspect, a method of manufacturing a shaker screen assembly is provided. The method comprises:

(a) providing a support frame that defines a frame opening, the support frame having a top frame surface and a bottom frame surface opposing the top frame surface;

(b) providing a planar panel having an upper panel surface, a lower panel surface opposing the upper panel surface, a panel peripheral sidewall connecting the upper panel surface and the lower panel surface together, a plurality of undulation sealing tabs attached to the planar panel, and a plurality of panel perforations extending through the upper panel surface and the lower panel surface;

(c) bending the undulation sealing tabs attached to the planar panel such that the undulation sealing tabs extend approximately perpendicularly with respect to the upper panel surface and the lower panel surface;

(d) assembling a mesh section that includes at least one mesh layer and at least one plastic layer, the mesh section having a top mesh section surface, a bottom mesh section surface opposing the top mesh section surface, a mesh section peripheral edge connecting the top mesh section surface and the bottom mesh section surface together, and a plurality of mesh section openings extending through the top and bottom mesh section surfaces, wherein the mesh section peripheral edge includes a first side and an opposing second side;

(e) heating the mesh section in a heat press to bond the mesh layer(s) and plastic layer together;

(f) using a press brake to form a series of undulations extending from the first side of the mesh section peripheral edge to the second side of the mesh section peripheral edge, each of the undulations including an elongated base portion and an elongated raised portion;

(g) applying a powder coating to the support frame and the planar panel;

(h) placing the mesh section on top of the planar panel and heating the mesh section and planar panel in a heat press to attach the mesh section to the planar panel to form a screen subassembly, wherein the mesh section is attached to the planar panel such that:

i) the mesh section openings are positioned over the panel perforations;

ii) the elongated base portions of the undulations are attached to the upper panel surface;

iii) the elongated raised portions of the undulations form a series of elongated open areas positioned between the upper panel surface and the bottom mesh section surface and extending over the panel perforations from the first side of the mesh section peripheral edge to the second side of the mesh section peripheral edge, each of the elongated open areas having a first open end and a second open end opposing the first open end, each of the first and second open ends being positioned adjacent to the panel peripheral sidewall and mesh section peripheral edge; and iv) an undulation sealing tab of the planar panel is positioned in each of the first and second open ends of the elongated open areas;

(i) placing the screen subassembly on top of the support frame and heating the screen subassembly and support frame in a heat press to attach the screen subassembly to the support frame.

BRIEF DESCRIPTION OF THE DRAWINGS

The drawings included with this application illustrate certain aspects of specific embodiments of the process disclosed herein. However, the embodiments disclosed herein, as shown by the drawings, should not be viewed as the exclusive embodiments. The subject matter disclosed herein is capable of considerable modifications, alterations, combinations, and equivalents in form and function, as will occur to those skilled in the art with the benefit of this disclosure. For example, the specific views in the drawings are not representative of the exact size of the items shown.

FIG. 6 is an enlarged perspective view of a portion of the planar panel of the shaker screen assembly and screen subassembly shown by FIGS. 1 and 2 illustrating pairs of undulation sealing tabs, including the outside sealing tab and inside sealing tab of each pair.

DETAILED DESCRIPTION

Figure 1:
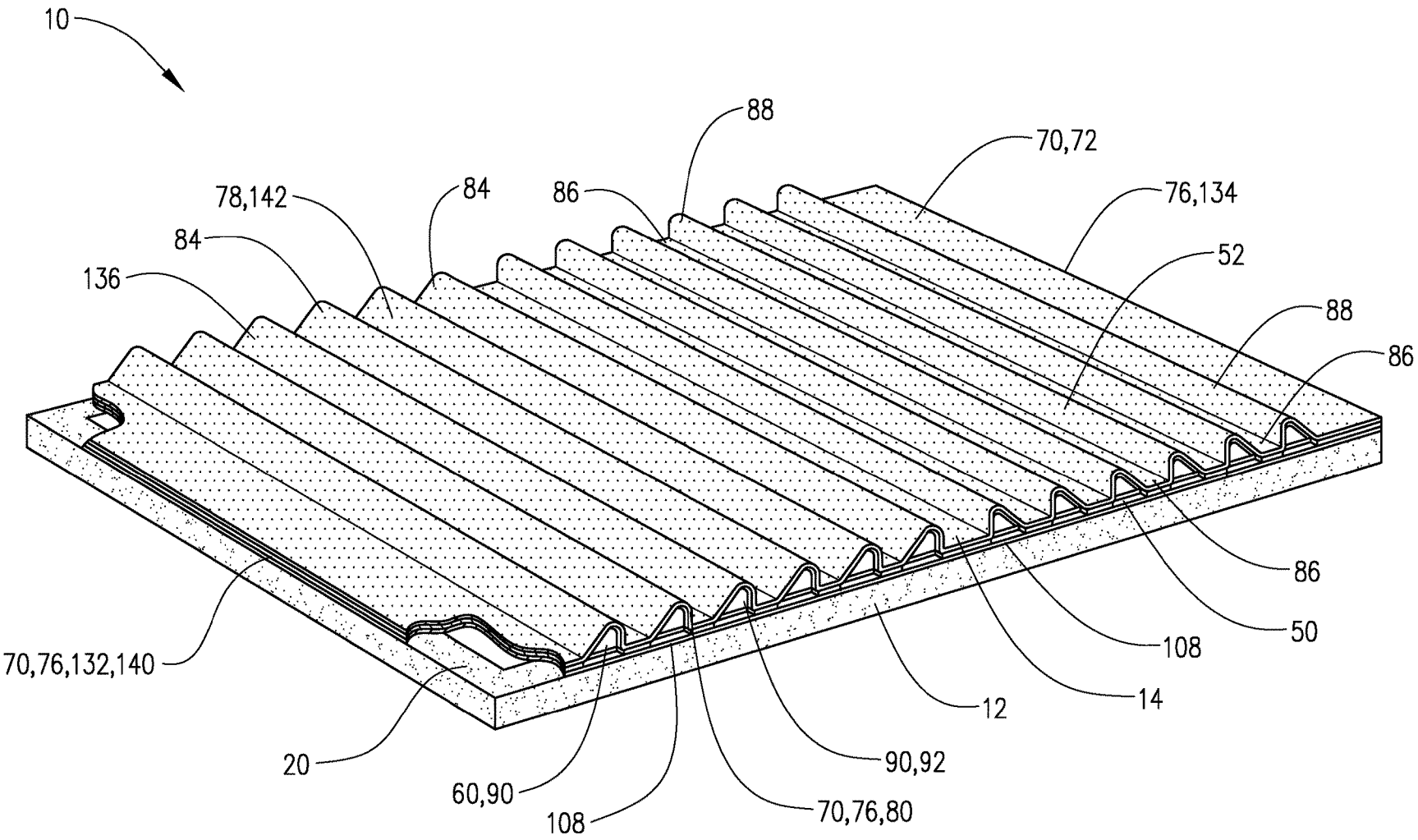
FIG. 1 is a top perspective view of the shaker screen assembly disclosed herein.
Figure 2:
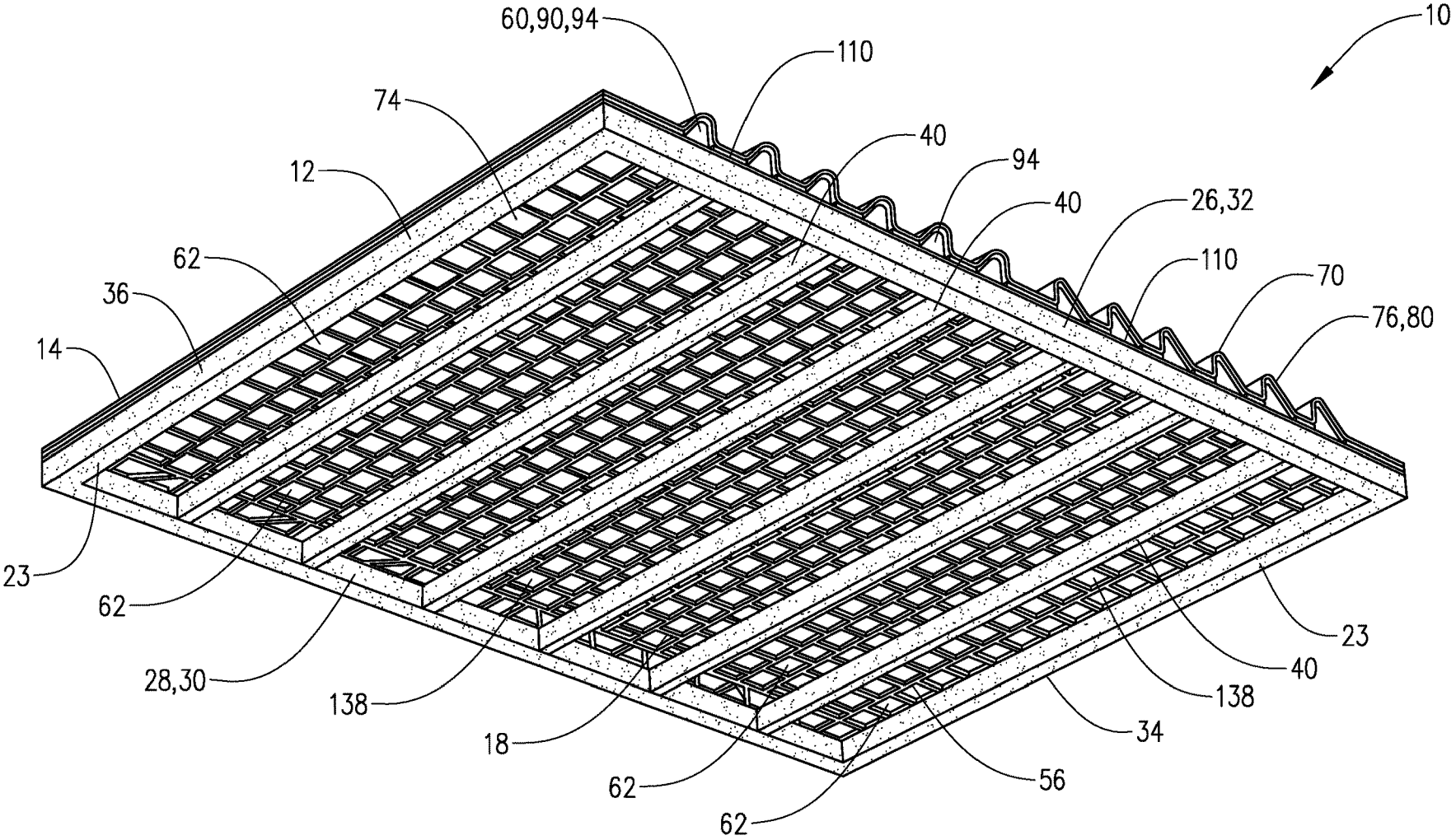
FIG. 2 is a bottom perspective view of the shaker screen assembly illustrated by FIG. 1.
Figure 3:
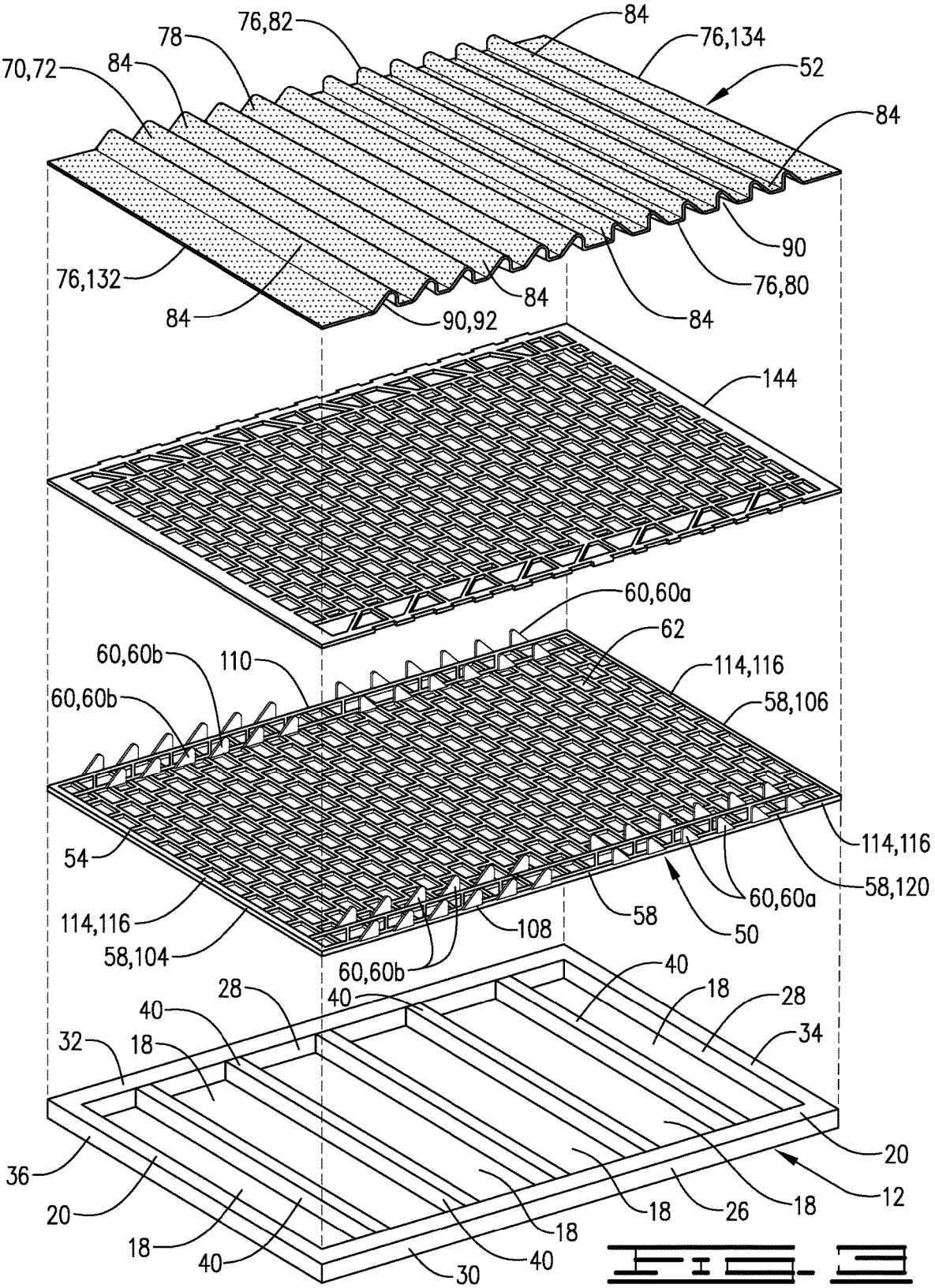
FIG. 3 is an exploded view of the shaker screen assembly illustrated by FIGS. 1 and 2 showing the components of the shaker screen assembly before they are bonded and attached together.

The present disclosure may be understood more readily by reference to this detailed description as well as to the specific embodiments described herein. For simplicity and clarity of illustration, where appropriate, reference numerals may be repeated among portions of the drawings to indicate corresponding or analogous elements. In addition, numerous specific details are set forth in order to provide a thorough understanding of the disclosed subject matter and various embodiments described herein. However, it will be understood by those of ordinary skill in the art that the subject matter and embodiments described herein can be practiced without these specific details. In other instances, for example, components have not been described in detail so as not to obscure the related relevant feature being described. Also, the description is not to be considered as limiting the scope of the subject matter described herein. The drawings are not necessarily to scale and the proportions of certain parts may have been exaggerated to better illustrate details and features of the present disclosure.

As used herein and in the appended claims, terms describing the orientation of components such as top, bottom, lowermost, etc. are to be construed in view of the manner in which the components are oriented in the drawings included herewith.

As used herein and in the appended claims, an element or component that "comprises" or "includes" one or more specified components means that the element or component includes the specified component(s) alone, or includes the specified component(s) together with one or more additional components. An element or component that "consists of" one or more specified components means that the element or component includes only the specified component(s). An element or component that "consists essentially of" one or more specified components means that the element or component consists of the specified component(s) alone, or consists of the specified component(s) together with one or more additional components that do not materially affect the basic properties of the element or component. Whenever a range is disclosed herein, the range includes independently and separately every member of the range extending between any two numbers enumerated within the range. Furthermore, the lowest and highest numbers of any range shall be understood to be included within the range set forth.

In accordance with this disclosure, a shaker screen assembly, a screen subassembly, and a method of making a screen subassembly are provided.

Referring now to the drawings, the shaker screen assembly, generally designated by the reference number 10, will be described. As shown, the shaker screen assembly comprises a support frame 12, and a screen subassembly 14 attached to the support frame.

The support frame 12 defines a frame opening 18 and has a top frame surface 20, a bottom frame surface 23 opposing the top frame surface, an outside surface 26 and an inside surface 28. As shown by the drawings, the support frame 12 has the shape of a rectangle and also includes a pair of opposing frame sides 30 and 32, a pair of opposing frame ends 34 and 36 connecting the frame sides together, and a plurality of crossbars 40 extending between the frame sides and further connecting the frame sides together. The support frame 12 is formed of a metal or steel. For example, the support frame 12 is formed of a metal. For example, the support frame 12 is formed of steel.

As shown by FIGS. 3-6, the screen subassembly 14 includes a planar panel 50, and a mesh section 52 attached to the planar panel.

The planar panel 50 has an upper panel surface 54, a lower panel surface 56 opposing the upper panel surface, a panel peripheral sidewall 58 connecting the upper panel surface and the lower panel surface together, a plurality of undulation sealing tabs 60 attached to the planar panel and extending approximately perpendicularly with respect to the upper panel surface and the lower panel surface, and a plurality of panel perforations 62 extending through the upper panel surface and the lower panel surface. As used herein and in the appended claims, "extending approximately perpendicularly with respect to the upper panel surface and the lower panel surface" means extending at an angle in the range of from about 70° to 110° with respect to the upper panel surface and the lower panel surface. For example, the undulation sealing tabs 60 can extend at an angle in the range of from about 80° to 100° with respect to the upper panel surface and the lower panel surface. For example, the undulation sealing tabs 60 can extend perpendicularly (that is, at an angle of 90°) with respect to the upper panel surface and the lower panel surface. The planar panel 50 is formed of a metal. For example, the planar panel is formed of iron. For example, the panel perforations 62 can have square or rectangular shapes.

The mesh section 52 includes at least one mesh layer 70, and has a top mesh section surface 72, a bottom mesh section surface 74 opposing the top mesh section surface, a mesh section peripheral edge 76 connecting the top mesh section surface and the bottom mesh section surface together, and a plurality of mesh section openings 78 extending through the top and bottom mesh section surfaces. The mesh section peripheral edge 76 includes a first side 80 and an opposing second side 82. The mesh section 52 includes a series of undulations 84 extending from the first side 80 of the mesh section peripheral edge 76 to the second side 82 of the mesh section peripheral edge, each of the undulations including an elongated base portion 86 and an elongated raised portion 88. The mesh layer(s) 70 (and hence the mesh section 52) can be formed of stainless steel.

The mesh section 52 is attached to the planar panel 50 such that: a) the mesh section openings 78 are positioned over the panel perforations 62; b) the elongated base portions 86 of the undulations 84 are attached to the upper panel surface 54; c) the elongated raised portions 88 of the undulations form a series of elongated open areas 90 positioned between the upper panel surface 54 and the bottom mesh section surface 74 and extending over the panel perforations 62 from the first side 80 of the mesh section peripheral edge 76 to the second side 82 of the mesh section peripheral edge 76, each of the elongated open areas having a first open end 92 and a second open end 94 opposing the first open end, each of the first and second open ends being positioned adjacent to the panel peripheral sidewall 58 and mesh section peripheral edge 76; and d) a sealing tab 60 of the planar panel 50 is positioned in each of the first and second open ends 92 and 94 of the elongated open areas 90. As used herein and in the appended claims, "positioned in each of the first and second open ends 92 and 94 of the elongated open areas 90" means positioned either within or just outside of each of the first and second open ends of the open areas (i.e., close enough to cover and seal the openings once the process for manufacturing the shaker screen assembly 10 is complete). The undulation sealing tabs 60 help prevent fluid from flowing or leaking through the open ends 92 and 94 of the elongated open areas 90 instead of the planar panel 50 and bottom of the shaker screen assembly when the shaker screen assembly 10 is in use.

As shown by the drawings, the planar panel 50 also has the shape of a rectangle. The planar peripheral sidewall 58 of the planar panel includes opposing first and second sidewall ends 104 and 106 and opposing first and second sidewall sides 108 and 110 connecting the first and second sidewall ends together. The undulation sealing tabs 60 are attached to the first and second sidewall sides 108 and 110.

The planar panel 50 further comprises a panel peripheral section 114 positioned between the panel peripheral sidewall 58 and the panel perforations 62, the panel peripheral section having a top surface 116, a bottom surface 118 opposing the top surface, and an outside edge 120 and inside edge 122 connecting the top surface and the bottom surface together. The outside edge 120 of the panel peripheral section 114 is the panel peripheral sidewall 58.

Figure 4A:
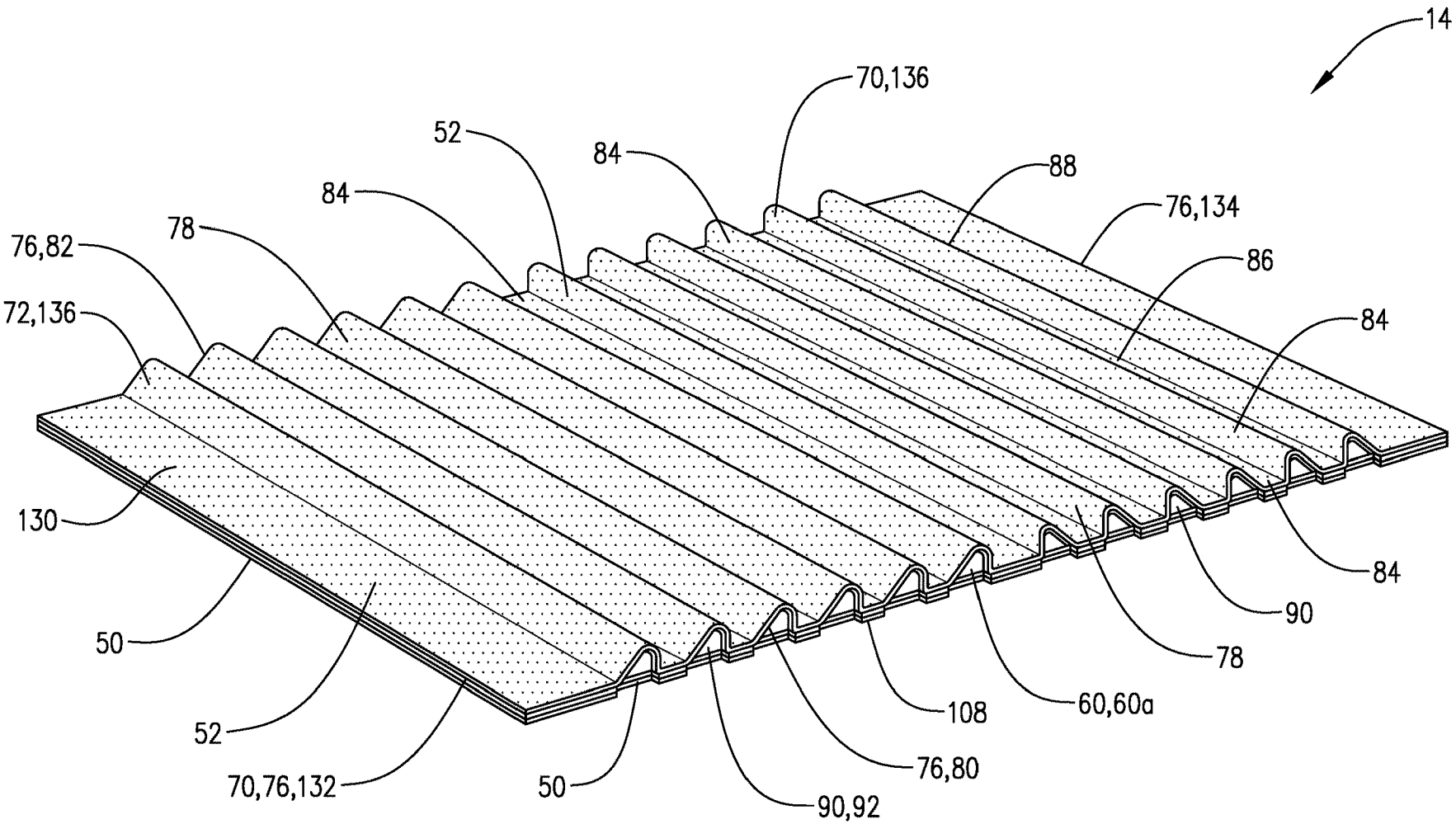
FIG. 4A is a top perspective view of the screen subassembly of the shaker screen assembly illustrated by FIGS. 1 and 2.

In one embodiment, as best shown by FIG. 4A, the undulation sealing tabs 60 are attached to the outside edge 120 of the panel peripheral section 114 of the first and second sidewall sides 108 and 110.

Figure 4B:
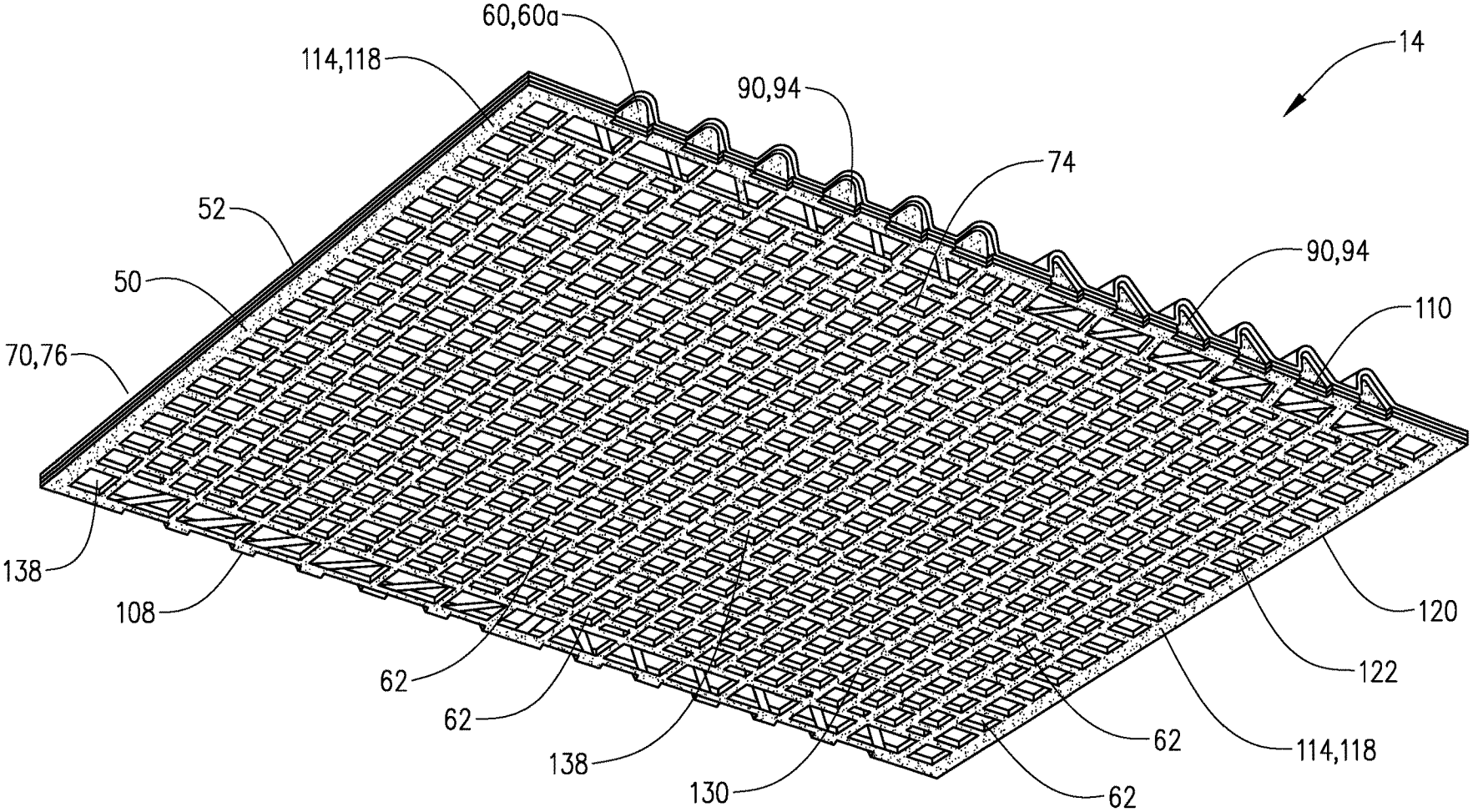
FIG. 4B is a bottom perspective view of the screen subassembly of the shaker screen assembly illustrated by FIGS. 1 and 2.
Figure 5A:
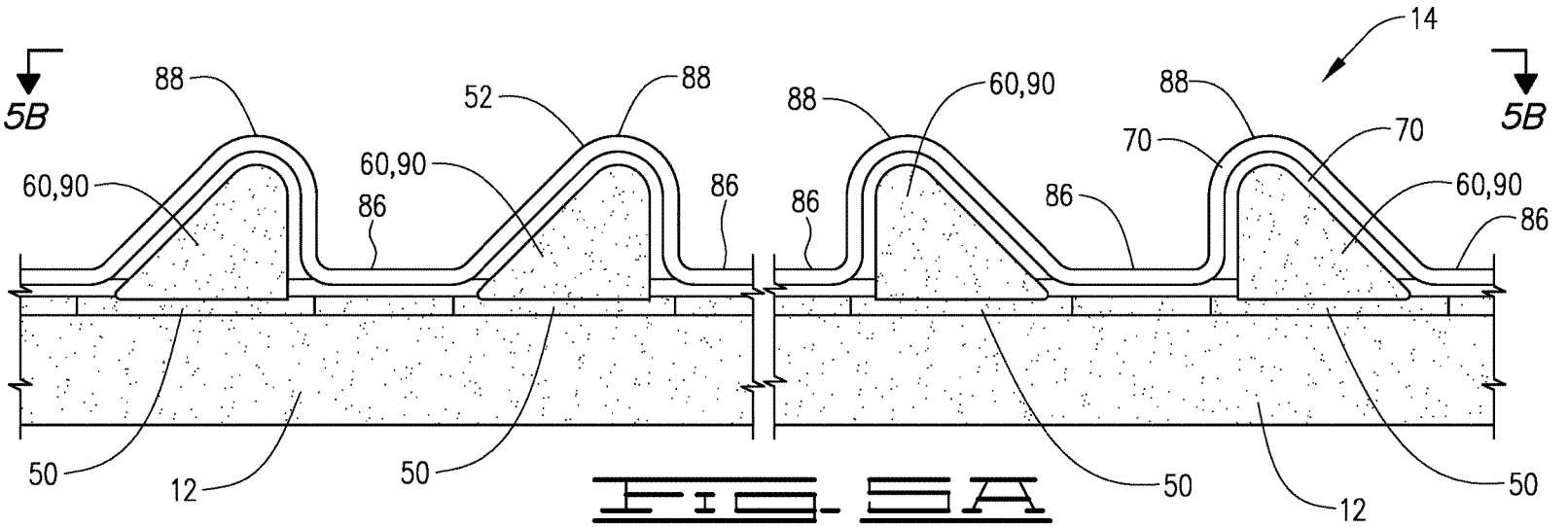
FIG. 5A is an enlarged, side elevation view of a portion the shaker screen assembly shown by FIGS. 1 and 2.
Figure 5B:
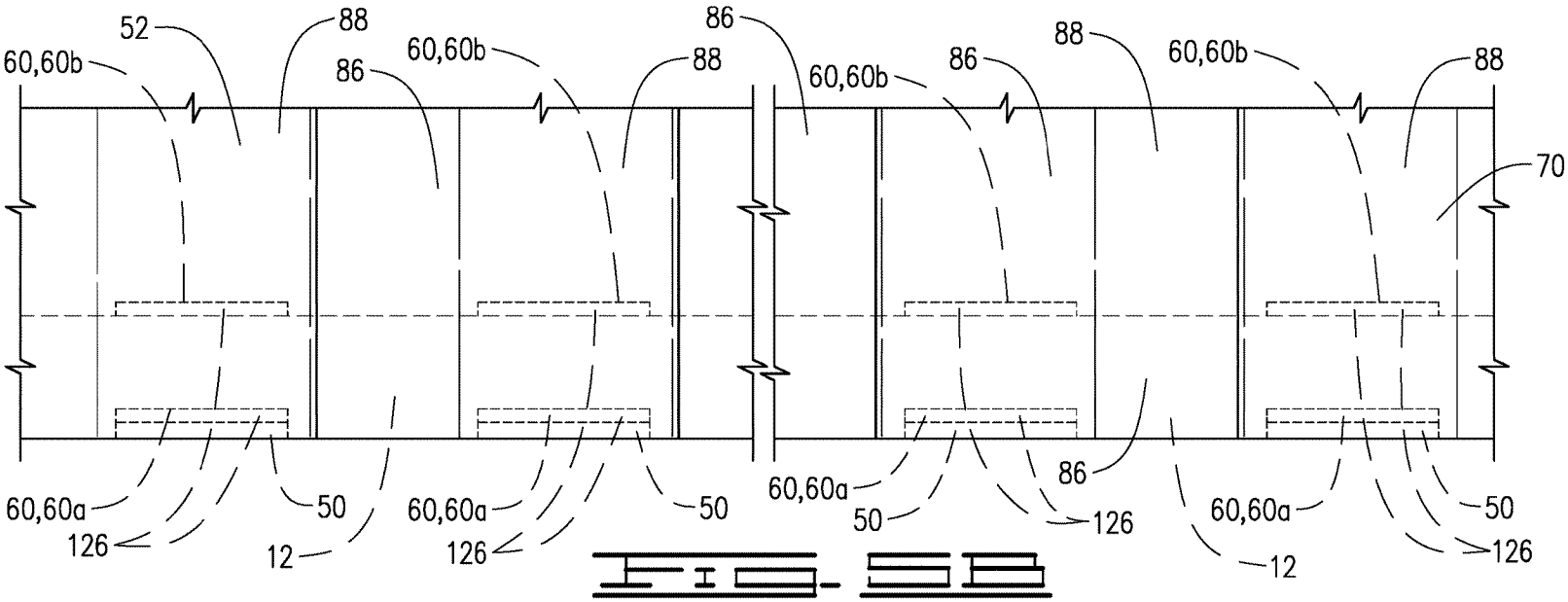
FIG. 5B is a cross-sectional view taken along lines 5B-5-B of FIG. 5A.
Figure 3:
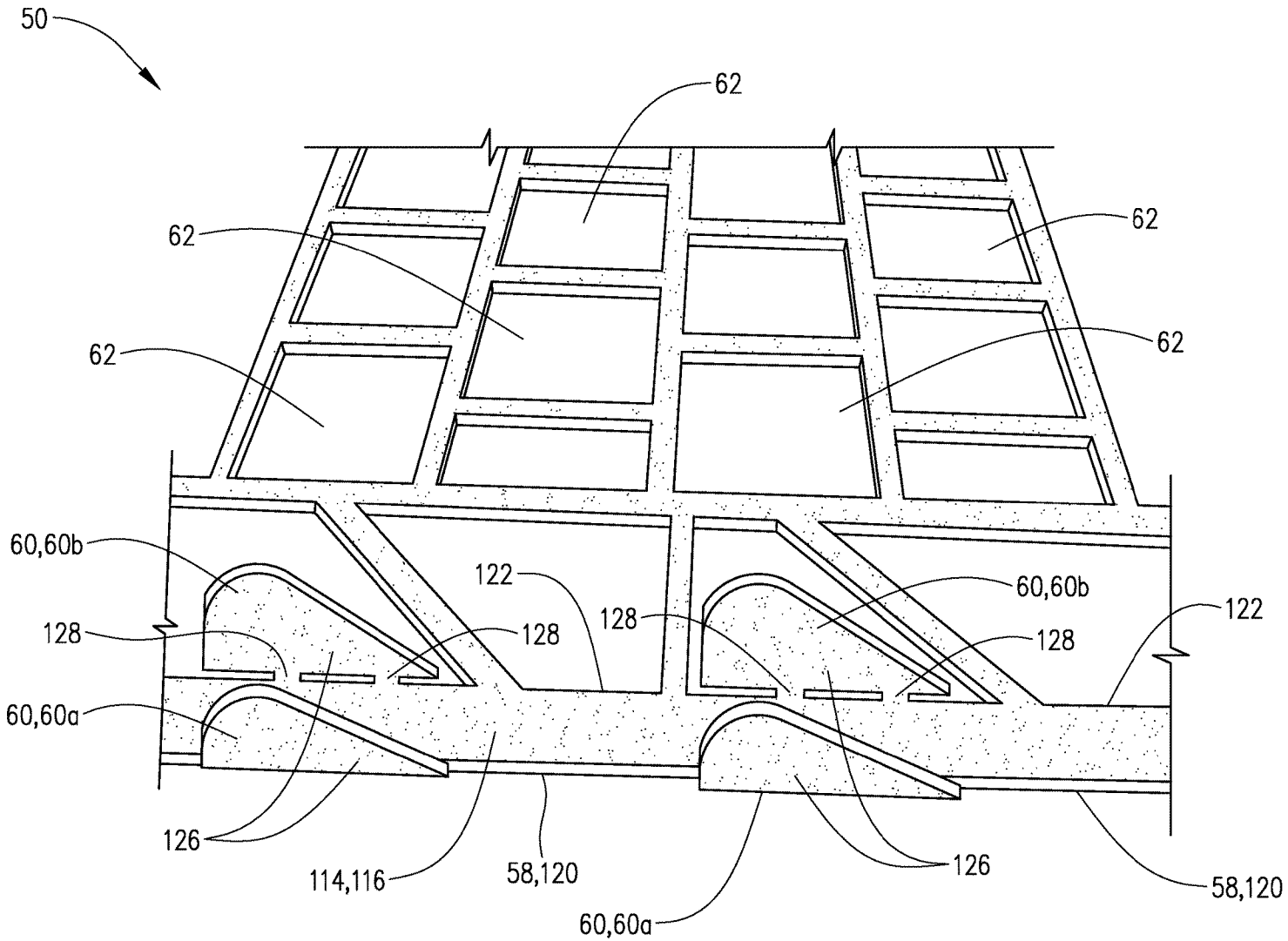

In another embodiment, as best shown by FIG. 4B, a plurality of pairs 126 of undulation sealing tabs 60 are attached to the planar panel 50, each of the pairs of undulation sealing tabs including an outside sealing tab 60*a* attached to the outside edge 120 of the panel peripheral section 114 and an inside sealing tab 60*b* attached to the inside edge 122 of the peripheral section directly across from the outside sealing tab 60*a*. In this embodiment, the mesh section 52 is attached to the planar panel 50 such that a pair 126 of undulation sealing tabs 60 (including an outside sealing tab 60*a* and inside sealing tab 60*b*) is positioned in each of the first and second open ends 92 and 94 of the elongated open areas 90. As used herein and in the appended claims, with respect to the outside sealing tab 60*a*, "positioned in each of the first and second open ends 92 and 94 of the elongated open areas 90" means positioned either within or just outside of each of the first and second ends of the open areas (i.e., close enough to cover and seal the openings once the process for manufacturing the shaker screen assembly 10 is complete). The pairs 126 of undulation sealing tabs 60*a* and 60*b* further help prevent fluid from flowing or leaking through the open ends 92 and 94 when the shaker screen assembly is in use. A pair of adjacent tabs provides an even more reliable seal. Three or more sealing tables can also be used.

As best shown by FIG. 4A, the undulation sealing tabs 60 are connected to the outside edge 120 and/or inside edge 122 of the panel peripheral section 114 by a pair of connection tabs 128.

Each of the support frame 12 and the planar panel 50 further include a powder coating 130. The powder coating 130 is deposited on all outside surfaces of the support frame and planar panel. As discussed below, when heat is applied to the shaker screen assembly and components thereof, the powder coating 130 helps bond the various components of the shaker screen assembly together and seal the undulation sealing tabs 60 (for example, the outside sealing tabs 60*a*) within the open ends 92 and 94 of the elongated open areas 90.

As shown by the drawings, the mesh section 52 also has the shape of a rectangle. The mesh section peripheral edge 76 further includes a first end 132 and a second end 134 connecting the first side 80 and second side 82 of the mesh section peripheral edge together. For example, as best shown by FIG. 6, the mesh section 52 can include at least two mesh layers 70 positioned one on top of the other. For example, the mesh layers 70 can all have the same size and shape. As shown, the individual mesh layers each have the shape of a rectangle. and each have a top mesh surface 136, a bottom mesh surface 138 opposing the top mesh surface, a mesh layer peripheral edge 140 connecting the top mesh surface and the bottom mesh surface together and a plurality of mesh openings 142 extending through the top and bottom mesh surfaces. For example, the top mesh surface 136 of the uppermost mesh layer 70 is the top mesh section surface 72. For example, in one embodiment, the mesh section 52 includes three mesh layers 70 positioned one on top of the other.

For example, the screen subassembly 14 can further comprise at least one plastic layer 144 positioned adjacent to and attached to one or more of the mesh layers 70. For example, as shown, the plastic layer(s) 144 can be positioned between the upper panel surface 54, and the bottom mesh section surface 74. As discussed below, when the heating the mesh section in a heat press, for example, the mesh layer(s) 70 and plastic layer(s) 144 bond together. Upon heating, the plastic layer(s) 144 at least somewhat disintegrate and become dispersed throughout the plastic layer(s) 70 and help, for example, to facilitate the formation and durability of the undulations 84.

For example, the sizes of the mesh openings 142 (and hence the mesh section openings 78) and the resulting cut point and API classification of the overall shaker screen assembly 10 can vary depending on the particular application including the size of the solid particles desired to be separated from the fluid to be filtered. c The screen subassembly 14 can be attached to the support frame 12 by a variety of different attachment methods including attachment by rivets and attachment by glue or epoxy. As described below, the screen subassembly 14 can also be attached to the support frame by heating the components and allowing the powder coated support frame 12 to bond to the powder coated planar panel 50.

The shaker screen assembly 10 disclosed herein can be used in association with a vibratory shaker machine that is used, for example, to separate solids from a mixture of solids and liquids. For example, the shaker screen assembly 10 disclosed herein can be used in association with a vibratory shaker machine that is used to separate solids from used drilling mud.

For example, in one embodiment, the shaker screen assembly comprises a support frame that defines a frame opening, and a screen subassembly attached to the support frame. The support frame has a top frame surface and a bottom frame surface opposing the top frame surface. The screen subassembly includes:

a planar panel having an upper panel surface, a lower panel surface opposing the upper panel surface, a panel peripheral sidewall connecting the upper panel surface and the lower panel surface together, a plurality of undulation sealing tabs attached to the planar panel and extending approximately perpendicularly with respect to the upper panel surface and the lower panel surface, and a plurality of panel perforations extending through the upper panel surface and the lower panel surface, wherein said panel peripheral sidewall includes opposing first and second sidewall ends and opposing first and second sidewall sides connecting the first and second sidewall ends together, and wherein the planar panel further comprises a panel peripheral section positioned between the panel peripheral sidewall and the panel perforations, the peripheral section having a top surface, a bottom surface opposing the top surface, and an outside edge and an inside edge connecting the top surface and the bottom surface together, wherein the outside edge of the panel peripheral section is the peripheral sidewall, and wherein a plurality of pairs of undulation sealing tabs are attached to the planar panel, each of said pairs of undulation sealing tabs including an outside sealing tab attached to said outside edge of said panel peripheral section and an inside sealing tab attached to said inside edge of said peripheral section directly across from said outside sealing tab;

a mesh section attached to the planar panel and including at least one mesh layer, the mesh section having a top mesh section surface, a bottom mesh section surface opposing the top mesh section surface, a mesh section peripheral edge connecting the top mesh section surface and the bottom mesh section surface together, and a plurality of mesh section openings extending through the top and bottom mesh section surfaces, wherein the mesh section peripheral edge includes a first side and an opposing second side and the mesh section includes a series of undulations extending from the first side of the mesh section peripheral edge to the second side of the mesh section peripheral edge, each of the undulations including an elongated base portion and an elongated raised portion, and wherein the mesh section is attached to the planar panel such that:

a) the mesh section openings are positioned over the panel perforations;

b) the elongated base portions of the undulations are attached to the upper panel surface;

c) the elongated raised portions of the undulations form a series of elongated open areas positioned between the upper panel surface and the bottom mesh section surface and extending over the panel perforations from the first side of the mesh section peripheral edge to the second side of the mesh section peripheral edge, each of the elongated open areas having a first open end and a second open end opposing the first open end, each of the first and second open ends being positioned adjacent to the panel peripheral sidewall and mesh section peripheral edge; and d) a pair of undulation sealing tabs is positioned in each of the first and second open ends of the elongated open areas.

The screen subassembly disclosed herein is the screen subassembly 14 described above.

With reference to the drawings including herewith, the method of manufacturing a shaker screen assembly disclosed herein comprises:

(a) providing a support frame 12 that defines a frame opening 18, the support frame having a top frame surface 20 and a bottom frame surface 22 opposing the top frame surface;

(b) providing a planar panel 50 having an upper panel surface 54, a lower panel surface 56 opposing the upper panel surface, a panel peripheral sidewall 58 connecting the upper panel surface and the lower panel surface together, a plurality of undulation sealing tabs 60 attached to the planar panel, and a plurality of panel perforations 62 extending through the upper panel surface and the lower panel surface;

(c) bending the undulation sealing tabs 60 attached to the planar panel 50 such that the undulation sealing tabs extend approximately perpendicularly with respect to the upper panel surface 54 and the lower panel surface 56;

(d) assembling a mesh section 52 that includes at least one mesh layer 70 and at least one plastic layer 144, the mesh section having a top mesh section surface 72, a bottom mesh section surface 74 opposing the top mesh section surface, a mesh section peripheral edge 76 connecting the top mesh section surface and the bottom mesh section surface together, and a plurality of mesh section openings 78 extending through the top and bottom mesh section surfaces, wherein the mesh section peripheral edge includes a first side 80 and an opposing second side 82;

(e) heating the mesh section in a heat press to bond the mesh layer(s) 70 and plastic layer(s) 144 together;

(f) using a press brake to form a series of undulations 84 extending from the first side 80 of the mesh section peripheral edge to the second side 82 of the mesh section peripheral edge, each of the undulations including an elongated base portion 86 and an elongated raised portion 88;

(g) applying a powder coating 130 to the support frame 12 and the planar panel 50;

(h) placing the mesh section 52 on top of the planar panel 50 and heating the mesh section and planar panel in a heat press to attach the mesh section to the planar panel to form a screen subassembly 14, wherein the mesh section is attached to the planar panel such that:

i. the mesh section openings 78 are positioned over the panel perforations 62;

ii. the elongated base portions 86 of the undulations 84 are attached to the upper panel surface 54;

iii. the elongated raised portions 88 of the undulations 84 form a series of elongated open areas 90 positioned between the upper panel surface 54 and the bottom mesh section surface 74 and extending over the panel perforations 62 from the first side 80 of the mesh section peripheral edge to the second side 82 of the mesh section peripheral edge, each of the elongated open areas having a first open end 92 and a second open end 94 opposing the first open end, each of the first and second open ends being positioned adjacent to the panel peripheral sidewall 58 and mesh section peripheral edge 76; and iv. an undulation sealing tab 60 of the planar panel 50 is positioned in each of the first and second open ends 92 and 94 of the elongated open areas 90;

(i) placing the screen subassembly 14 on top of the support frame 12 and heating the screen subassembly 14 and support frame in a heat press to attach the screen subassembly to the support frame.

In steps (h) and (i), the heat treatment causes the powder coating 130 to bond the various components of the shaker screen assembly together and seal the undulation sealing tabs 60 within the open ends 92 and 94 of the elongated open areas 90. For example, the plastic layer(s) For example, the powder coat 130 bonds the undulation sealing tabs 60 to the mesh section 52.

In use, one or more of the shaker screen assemblies 10 are inserted and attached to a shaker machine. For example, the ends of each assembly 10, including the ends of the support frame and screen subassembly, can be inserted into a corresponding fastening apparatus (e.g., wedge fasteners) in the machine. Once the shaker screen assembly or assemblies are in place, a mixture of solids and liquids (e.g., used drilling mud) is pumped onto the top mesh section surface 72. As the shaker screen assembly 10 is vibrated by the shaker machine, solids of a desired shape are filtered by the shaker screen assembly. The remaining fluid flows through the shaker screen assembly and is conducted to the next processing step. The vibration of the shaker screen assembly 10 facilitates the filtration process and causes the separated solids to slide off the top mesh section surface 72.

Therefore, the shaker screen assembly, screen subassembly and method disclosed herein are well adapted to attain the ends and advantages mentioned, as well as those that are inherent therein. The embodiments disclosed are illustrative only, as the shaker screen assembly, screen subassembly and method disclosed herein may be modified and practiced in different but equivalent manners, as will be apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified, and all such variations are considered within the scope and spirit of the present process. While the present shaker screen assembly, screen subassembly and method and the individual components and steps thereof may be described in terms of "comprising," "containing," "having," or "including" various steps or components, the process and system can also, in some examples, "consist essentially of" or "consist of" the various steps and components. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain ordinary meaning unless otherwise explicitly and clearly defined by the patentee.

What is claimed is:

1. A shaker screen assembly, comprising:

a support frame that defines a frame opening, said support frame having a top frame surface and a bottom frame surface opposing said top frame surface; and a screen subassembly attached to said support frame, said screen subassembly, including:

a planar panel having an upper panel surface, a lower panel surface opposing said upper panel surface, a panel peripheral sidewall connecting said upper panel surface and said lower panel surface together, a plurality of undulation sealing tabs attached to said planar panel and extending approximately perpendicularly with respect to said upper panel surface and said lower panel surface, and a plurality of panel perforations extending through said upper panel surface and said lower panel surface; and a mesh section attached to said planar panel and including at least one mesh layer, said mesh section having a top mesh section surface, a bottom mesh section surface opposing said top mesh section surface, a mesh section peripheral edge connecting said top mesh section surface and said bottom mesh section surface together, and a plurality of mesh section openings extending through said top and bottom mesh section surfaces, wherein said mesh section peripheral edge includes a first side and an opposing second side and said mesh section includes a series of undulations extending from said first side of said mesh section peripheral edge to said second side of said mesh section peripheral edge, each of said undulations including an elongated base portion and an elongated raised portion, and wherein said mesh section is attached to said planar panel such that:

a) said mesh section openings are positioned over said panel perforations;

b) said elongated base portions of said undulations are attached to said upper panel surface;

c) said elongated raised portions of said undulations form a series of elongated open areas positioned between said upper panel surface and said bottom mesh section surface and extending over said panel perforations from said first side of said mesh section peripheral edge to said second side of said mesh section peripheral edge, each of said elongated open areas having a first open end and a second open end opposing said first open end, each of said first and second open ends being positioned adjacent to said panel peripheral sidewall and mesh section peripheral edge; and d) an undulation sealing tab of said planar panel is positioned in each of said first and second open ends of said elongated open areas.

2. The shaker screen assembly of claim 1, wherein said support frame is formed of a metal or steel.

3. The shaker screen assembly of claim 1, wherein said planar panel is formed of metal.

4. The shaker screen assembly of claim 1, wherein said mesh layer(s) is formed of stainless steel.

5. The shaker screen assembly of claim 1, wherein said panel peripheral sidewall includes opposing first and second sidewall ends and opposing first and second sidewall sides connecting said first and second sidewall ends together, and wherein said undulation sealing tabs are attached to said first and second sidewall sides.

6. The shaker screen assembly of claim 5, wherein said planar panel further comprises a panel peripheral section positioned between said panel peripheral sidewall and said panel perforations, said peripheral section having a top surface, a bottom surface opposing said top surface, and an outside edge and an inside edge connecting said top surface and said bottom surface together, wherein said outside edge of said panel peripheral section is said peripheral sidewall.

7. The shaker screen assembly of claim 6, wherein said undulation sealing tabs are attached to said outside edge of said peripheral section.

8. The shaker screen assembly of claim 6, wherein a plurality of pairs of undulation sealing tabs are attached to said planar panel, each of said pairs of undulation sealing tabs including an outside sealing tab attached to said outside edge of said panel peripheral section and an inside sealing tab attached to said inside edge of said peripheral section directly across from said outside sealing tab, wherein said mesh section is attached to said planar panel such that a pair of undulation sealing tabs is positioned in each of said first and second open ends of said elongated open areas.

9. The shaker screen assembly of claim 1, wherein said mesh section includes at least two mesh layers positioned one on top of the other, each of said mesh layers having a top mesh surface, a bottom mesh surface opposing said top mesh surface, a mesh layer peripheral edge connecting said top mesh surface and said bottom mesh surface together, and a plurality of mesh openings extending through said top and bottom mesh surfaces.

10. A screen subassembly, comprising:

a planar panel having an upper panel surface, a lower panel surface opposing said upper panel surface, a panel peripheral sidewall connecting said upper panel surface and said lower panel surface together, a plurality of undulation sealing tabs attached to said planar panel and extending approximately perpendicularly with respect to said upper panel surface and said lower panel surface, and a plurality of panel perforations extending through said upper panel surface and said lower panel surface; and a mesh section attached to said planar panel and including at least one mesh layer, said mesh section having a top mesh section surface, a bottom mesh section surface opposing said top mesh section surface, a mesh section peripheral edge connecting said top mesh section surface and said bottom mesh section surface together, and a plurality of mesh section openings extending through said top and bottom mesh section surfaces, wherein said mesh section peripheral edge includes a first side and an opposing second side and said mesh section includes a series of undulations extending from said first side of said mesh section peripheral edge to said second side of said mesh section peripheral edge, each of said undulations including an elongated base portion and an elongated raised portion, and wherein said mesh section is attached to said planar panel such that:

a) said mesh section openings are positioned over said panel perforations;

b) said elongated base portions of said undulations are attached to said upper panel surface;

c) said elongated raised portions of said undulations form a series of elongated open areas positioned between said upper panel surface and said bottom mesh section surface and extending over said panel perforations from said first side of said mesh section peripheral edge to said second side of said mesh section peripheral edge, each of said elongated open areas having a first open end and a second open end opposing said first open end, each of said first and second open ends being positioned adjacent to said panel peripheral sidewall and mesh section peripheral edge; and d) an undulation sealing tab of said planar panel is positioned in each of said first and second open ends of said elongated open areas.

11. The shaker screen assembly of claim 10, wherein said panel peripheral sidewall includes opposing first and second sidewall ends and opposing first and second sidewall sides connecting said first and second sidewall ends together, and wherein said undulation sealing tabs are attached to said first and second sidewall sides.

12. The shaker screen assembly of claim 11, wherein said planar panel further comprises a panel peripheral section positioned between said panel peripheral sidewall and said panel perforations, said peripheral section having a top surface, a bottom surface opposing said top surface, and an outside edge and an inside edge connecting said top surface and said bottom surface together, wherein said outside edge of said panel peripheral section is said peripheral sidewall.

13. The shaker screen assembly of claim 12, wherein said undulation sealing tabs are attached to said outside edge of said peripheral section.

14. The shaker screen assembly of claim 12, wherein a plurality of pairs of undulation sealing tabs are attached to said planar panel, each of said pairs of undulation sealing tabs including an outside sealing tab attached to said outside edge of said panel peripheral section and an inside sealing tab attached to said inside edge of said peripheral section directly across from said outside sealing tab, wherein said mesh section is attached to said planar panel such that a pair of undulation sealing tabs is positioned in each of said first and second open ends of said elongated open areas.

15. The shaker screen assembly of claim 10, wherein said mesh section includes at least two mesh layers positioned one on top of the other, each of said mesh layers having a top mesh surface, a bottom mesh surface opposing said top mesh surface, a mesh layer peripheral edge connecting said top mesh surface and said bottom mesh surface together, and a plurality of mesh openings extending through said top and bottom mesh surfaces.

16. A method of manufacturing a shaker screen assembly, comprising:

(a) providing a support frame that defines a frame opening, said support frame having a top frame surface and a bottom frame surface opposing said top frame surface;

(b) providing a planar panel having an upper panel surface, a lower panel surface opposing said upper panel surface, a panel peripheral sidewall connecting said upper panel surface and said lower panel surface together, a plurality of undulation sealing tabs attached to said planar panel, and a plurality of panel perforations extending through said upper panel surface and said lower panel surface;

(c) bending said undulation sealing tabs attached to said planar panel such that said undulation sealing tabs extend approximately perpendicularly with respect to said upper panel surface and said lower panel surface;

(d) assembling a mesh section that includes at least one mesh layer and at least one plastic layer, said mesh section having a top mesh section surface, a bottom mesh section surface opposing said top mesh section surface, a mesh section peripheral edge connecting said top mesh section surface and said bottom mesh section surface together, and a plurality of mesh section openings extending through said top and bottom mesh section surfaces, wherein said mesh section peripheral edge includes a first side and an opposing second side;

(e) heating said mesh section in a heat press to bond said mesh layer(s) and plastic layer together;

(f) using a press brake to form a series of undulations extending from said first side of said mesh section peripheral edge to said second side of said mesh section peripheral edge, each of said undulations including an elongated base portion and an elongated raised portion;

(g) applying a powder coating to said support frame and said planar panel;

(h) placing said mesh section on top of said planar panel and heating said mesh section and planar panel in a heat press to attach said mesh section to said planar panel to form a screen subassembly, wherein said mesh section is attached to said planar panel such that:

i) said mesh section openings are positioned over said panel perforations;

ii) said elongated base portions of said undulations are attached to said upper panel surface;

iii) said elongated raised portions of said undulations form a series of elongated open areas positioned between said upper panel surface and said bottom mesh section surface and extending over said panel perforations from said first side of said mesh section peripheral edge to said second side of said mesh section peripheral edge, each of said elongated open areas having a first open end and a second open end opposing said first open end, each of said first and second open ends being positioned adjacent to said panel peripheral sidewall and mesh section peripheral edge; and iv) an undulation sealing tab of said planar panel is positioned in each of said first and second open ends of said elongated open areas;

(i) placing said screen subassembly on top of said support frame and heating said screen subassembly and support frame in a heat press to attach said screen subassembly to said support frame.

* * * * *